United States Patent [19]

Franceschini et al.

[11] Patent Number: 4,967,842

[45] Date of Patent: Nov. 6, 1990

[54] SUB SURFACE SAFETY VALVE BLOCK, PARTICULARLY SUITABLE FOR THE RISERS OF OFFSHORE PLATFORMS

[75] Inventors: Giuliano Franceschini, Padova; Giancarlo Amendola, Milan; Arthur R. Galletti di Cadilhac, Rome; Francesco Donati, Milan, all of Italy

[73] Assignee: Agip, S.p.A., Milan, Italy

[21] Appl. No.: 314,918

[22] Filed: Feb. 24, 1989

[30] Foreign Application Priority Data

Mar. 2, 1988 [IT] Italy ..... 19610 A/88

[51] Int. Cl.[5] ..... E21B 33/038

[52] U.S. Cl. ..... 166/345; 166/348; 166/363; 166/367

[58] Field of Search ..... 166/345, 348, 359, 360, 166/363, 367, 321

[56] References Cited

U.S. PATENT DOCUMENTS 3,137,348 6/1964 Ahlstone et al. ..... 166/348
4,403,658 9/1983 Watkins ..... 166/367 X

FOREIGN PATENT DOCUMENTS 0969887 10/1982 U.S.S.R. ..... 166/345

*Primary Examiner*—William P. Neuder

*Attorney, Agent, or Firm*—Hedman, Gibson, Costigan & Hoare

[57] ABSTRACT

An underwater sub-surface safety valve block is connected between a well head located at the sea bottom, and the lower end of a riser. This allows the production tube and/or the service tube of the completion string to be closed by means of gate valves. This sub-surface safety valve block comprises a valve body provided with a vertical through-bore tightly closed at its upper end by a packer to which the upper portion of the completion string is connected. The bottom is tightly closed by a tubing hanger to which the lower portion of the completion string is connected. The packer and the tubing hanger are fastened inside the through-bore by means of a mechanical hooking which can be disengaged by means of a hydraulic controlled action. They are each provided with a through-channel in order to connect the respective production tubes with the central region of the through-bore, which can be closed by means of a gate valve. The through-bore is also connected to two branched channels to connect the relevant service tube and the relevant hydraulic-drive lines used to drive the SCSSV safety valve, respectively with a service channel and a control channel provided inside said valve body, with a further gate valve to allow this latter service channel to be closed.

4 Claims, 3 Drawing Sheets

Fig.1
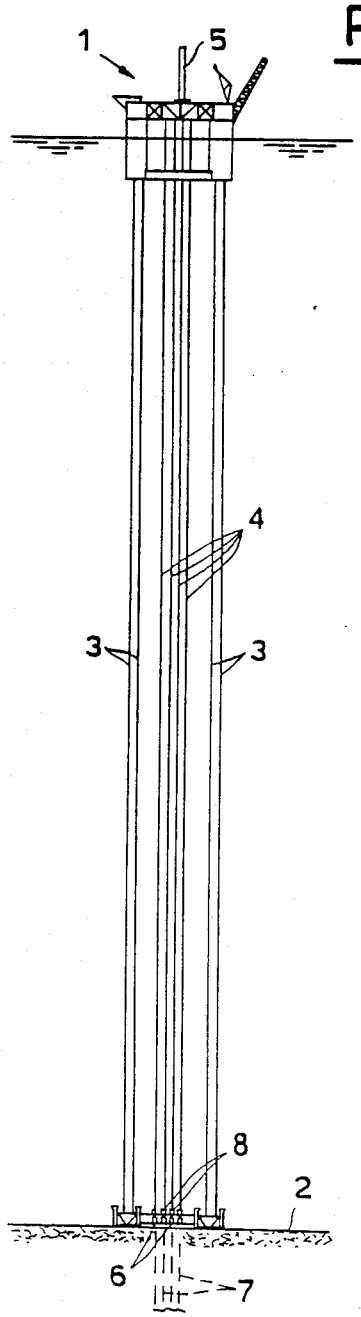
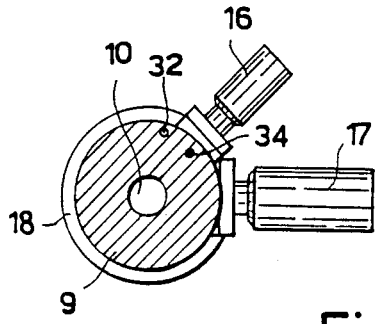
Fig.3
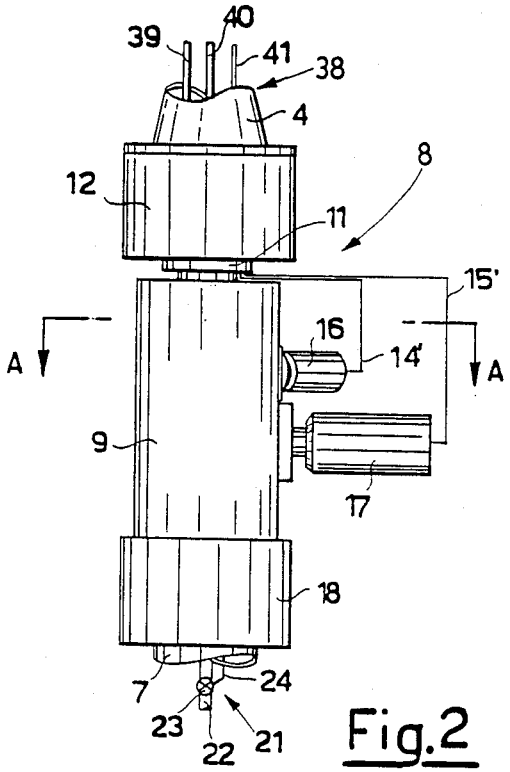
Fig.2

SUB SURFACE SAFETY VALVE BLOCK, PARTICULARLY SUITABLE FOR THE RISERS OF OFFSHORE PLATFORMS

FIELD OF THE INVENTION

The present invention relates to an underwater safety valve block which allows the whole completion string to be recovered, servicing operations to be carried out on the well, as well as the completion string to be applied again with the same valve block never having to be removed. This allows the completion string and any necessary tools to pass through the same valve block, and is particularly suitable for being applied to the lower end of a riser. This connects an underwater well head to the deck of an overhanging offshore platform, to independently intercept the stream flowing inside each tube which makes part of the completion string, i.e., the stream of hydrocarbons flowing inside the production tube and the fluid streams flowing inside the service tubes

DESCRIPTION OF THE PRIOR ART

According to the present state of the art, in the underwater production of hydrocarbons from stationary platforms, all of the borehole strings installed in a well are generally positioned vertically from the sea bottom up to the deck of the platform, to comprise a riser provided with a plurality of concentric walls, for an efficacious housing of the completion string.

Such a structure, by creating a safe continuous well free from interruptions, makes it possible to carry out any necessary operations inside the interior of the well, without having to take into account the surrounding sea. This allows the completion string to be easily recovered from the sea surface, with no need for any riser recovery operations having to be carried out.

However, when hydrocarbons are produced in very deep waters using, for example, platforms of TLP (Tension Leg Platforms) type, or single-leg platforms these do not allow the riser to be horizontally supported. Therefore, these require the riser to be put under tension from the platform, using low weight risers, with as small overall dimensions as possible. The wells are generally connected from the sea bottom to the deck of the platform by using a single rising string, or a single-well riser per each well.

This type of structure introduces serious safety considerations since it is provided with only one structural barrier which is less strong than traditional barriers which are situated between the external environment and the completion string. They also only have one safety valve to interrupt the flowing of the fluid stream from the field. These are commonly denominated "SSSV (Sub Surface Safety Valve)" and such a structure does not ensure complete reliability.

In order to solve the above-said safety problem, one could use an underwater valve block, interposed between the lower end of the riser and the well head at sea bottom. The valve block is provided with gate valves to reliably and discretely close each tube of the completion string when necessary.

Unfortunately, this solution has the serious drawback that it no longer allows the completion string to be easily removed and subsequently reinstalled. These operations are essential during the life of a well, to necessarily carry out extraordinary or ordinary well maintenance and to make possible other suitable actions to be carried out in the field, for the purpose of improving production.

In fact, the above said recovery of the completion string cannot be carried out without first removing the valve block. This recovery of the valve block implies the removal of the overhanging riser, as well as the reinstallation thereof, with obvious consequences of long dead times and laborious handling procedures, and hence high operating costs.

SUMMARY OF THE INVENTION

The purpose of the present invention is to obviate the above said drawbacks, and to therefore supply an underwater safety valve block applied between the sub surface well head and the lowermost end of the riser connecting said well head with the deck of an overhanging offshore platform. This not only allows the production tube and the service tubes of the completion string to be selectively closed by means of hydraulic-driven gate valves, but also enables all said completion strings to be recovered, without said valve block having to be removed. The hydraulic control line, is provided for driving the SSSV safety valve. This acts inside the production tube which is contained inside the lower portion of the completion string installed inside the well.

The above purpose is substantially achieved in the following manner. The completion string can be recovered by being run through a suitable vertical through-bore provided in said valve block. In the valve block the upper end of the lower portion of the completion string which is installed inside the well, and the lower end of the upper portion of the same completion string which is installed inside the riser are respectively connected to an underwater tubing hanger and to a packer. These are respectively fastened, with a tight sealing by means of gaskets and a mechanical hooking which is disengageable by means of a hydraulic-controlled action, to both ends of said through-bore. They are then each respectively provided with a through-channel which connects the production tubes of said lower portion and said upper portion of said completion string with the central region of said through-bore. This can be closed by means of a hydraulic-driven gate valve supported by the body of said valve block, as well as with branched channels. The channels substantially connect the service tube and the hydraulic control line for the hydraulic drive of the SSSV safety valve of the two portions of the completion string, through a relevant service channel and a relevant control channel provided inside said body of the valve block. A further hydraulic-driven gate valve - also supported by said valve block body - allows said service channel inside said valve block body to be closed, and said service channel provided inside said packer to be equipped with a nonreturn valve.

The packer is provided at its upper end, in correspondence of said channels with flares for housing, under tight-sealed conditions, the ends of the elements of said upper portion of the completion string, i.e., of the production tube and of the service tubes, as well as of the SSSV safety valve control line. It is thus evident that to recover the whole completion string, it is now only necessary to lift the upper portion of the completion string by sliding its elements out from the flares provided in the packer, to lift said packer after hydraulically disengaging it, and finally to lift said tubing hanger. Integral with the tubing hanger is the elements of the lower portion of the completion string after said tubing hanger is hydraulically disengaged from the well head. Making it slide through said through-bore of said valve block, can be carried out without removing the valve block and the riser. Also the closure of the production tube and/or of the service tubes can be achieved by hydraulically acting on said gate valves.

Summing up, the underwater safety valve block, is particularly suitable for being between a well head at the sea bottom, and the lower end of a riser which connects said well head with the deck of an overhanging offshore platform. This is to selectively close the production tube and/or the service tubes of a completion string by means of hydraulic-drive gate valves. The gate valves are supported by the body of said valve block, which also allows the hydraulic control line of said completion battery provided to control a safety valve - better known as an "SSSV". This acts on the production tube of the lower portion which is installed inside the well of the completion tubing, to be passed through said valve body. The body of said valve block is provided with a vertical through-bore wherein the upper end of said lower portion of the completion string is connected with an underwater tubing hanger. This is fastened with a tight sealing, inside the bottom end of said vertical thorough-bore by means of gaskets and a mechanical hooking means It is disengageable by means of a hydraulic-controlled action, and it is provided with a through-channel which connects the production tube of said lower portion of said completion string with the central region of said through-bore. This can be closed by means of one of said hydraulic-driven gate valves. The through bore is also connected to the branched channels provided to connect the service tube and the hydraulic control line respectively for the hydraulic drive of the SSSV safety valve of said lower portion of said completion string with a corresponding service channel and a corresponding control channel provided inside said body of the valve block, with another one of said hydraulic-driven gate valves. This allows the service channel inside said valve block body to be closed. The lower end of the upper portion is installed inside said riser of said completion string and is connected with a packer, which in turn is fastened under tight sealing conditions, inside the upper end of said vertical through-bore by means of gaskets, and a mechanical hooking means disengageable by means of a hydraulic-controlled action. This is provided with a through-channel which connects the production tube of said upper portion of said completion string with said central region of said through-bore. It is also connected with two branched channels to respectively connect the service tube and the hydraulic control line for the hydraulic drive of the SSSV safety valve of said upper portion of the completion string with said corresponding service channel and the control channel provided inside said body of the valve block, with said branched channel provided inside said packer which corresponds to the service tube being equipped with a nonreturn valve.

According to a preferred form of practical embodiment of the present invention, said bottom end of said upper portion of said completion string is connected with said packer by means of housing flares provided in the top portion of said packer. Inside this the lower ends of the production tube and the service tubes, as well as the SSSV safety valve control line, which comprises the upper end of said completion string, enter under tight-sealing conditions, with said flares being in correspondence of said channels provided in said packer.

On the other end, for the packer and the tubing hanger to be easily installed inside the vertical through-bore inside the body of said valve block, there is no need for their branched channels to be exactly aligned with the corresponding service channel and control channel provided inside said valve block body. According to a further feature of the present invention said branched channels, which are both provided in the packer and in the tubing hanger, are caused to open into the corresponding annular chambers which are provided around the peripheral surface of said packer and of said tubing hanger. These are opposite to said corresponding service channel and control channel of said body of said valve block.

Finally, to accomplish a further protective barrier between the inside of the well and the external marine environment, according to a further feature of the present invention said tubing hanger in correspondence with its bottom side, is provided with a protruding part. This part enters, under tight-seal conditions accomplished by means of gasket, the collar of the borehole string, which bounds said well.

BRIEF DESCRIPTION OF THE DRAWINGS

The invention is now explained in greater detail by referring to the hereto attached drawings, which illustrate a preferred form of practical embodiment of the same invention. This is given for merely exemplifying, non-limitating purposes, in that technical variants and structural modifications may be always be supplied without departing from the scope of the present invention.

In said drawings:

FIG. 1 shows a general view of an offshore platform in which safety valve blocks according to the present invention are used;

FIG. 2 shows a perspective, enlarged-scale, view of one of the safety valve blocks of FIG. 1;

FIG. 3 shows a sectional view made according to path AA of FIG. 2;

DESCRIPTION OF THE PREFERRED EMBODIMENT

Figure 4:
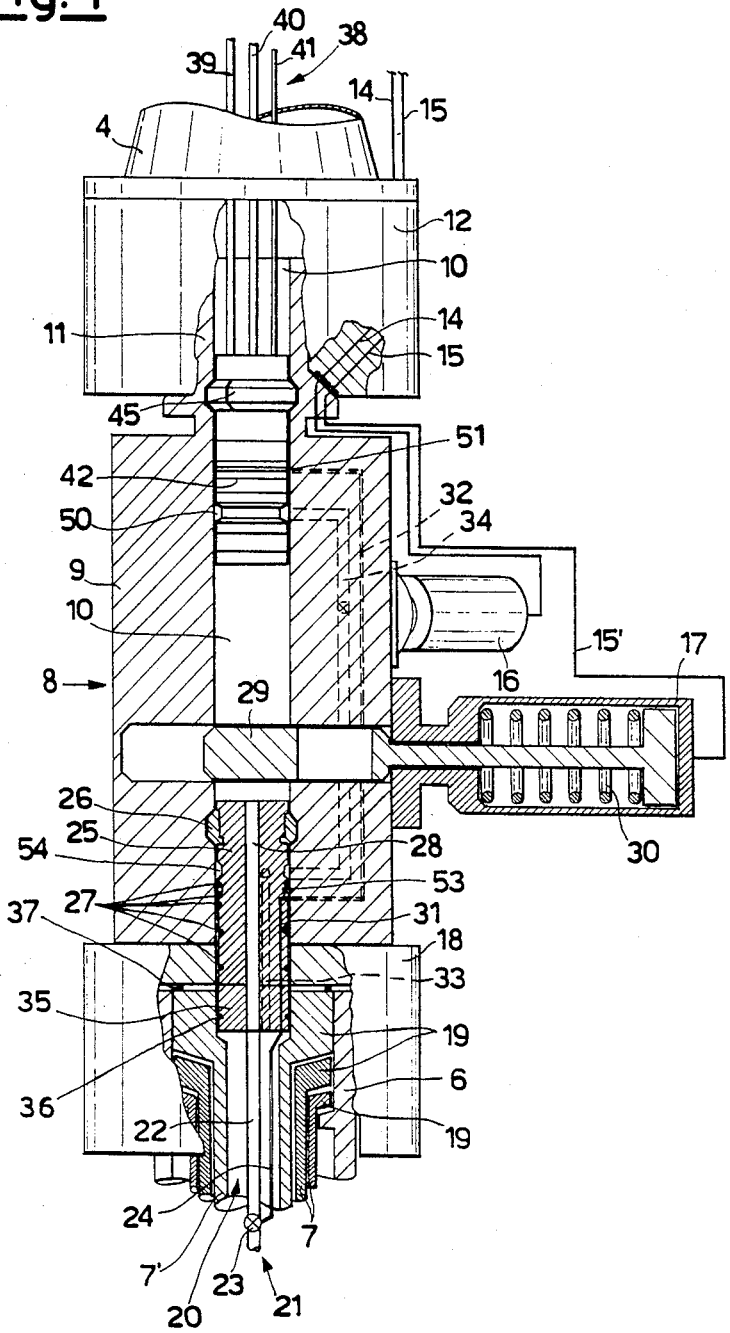
FIG. 4 shows a partially sectional, magnified front view of the valve block of FIG. 2.

Referring to the figures, the reference numeral 1 indicates an offshore platform of TLP (Tension Leg Platform) type, anchored to the sea bottom 2 by means of the tension legs 3. The reference number 4 indicates a set of risers which connect the deck 5 of said platform with corresponding well heads 6 at seat bottom, from which the borehole strings 7 leave. Between each well head 6 and the bottom end of each riser 4, and underwater safety valve block 8 is positioned.

In a more specific way, the block 8 comprises a valve body 9 which has a vertical through-bore 10, which ends at its top, with a male fitting 11 to which a connector bowl 12 integral with the bottom end of the corresponding riser 4 is connected, by known means. The above said connector bowl 12 furthermore contains the control lines 14 and 15 for the hydraulic actuators. These are for respectively driving the gate valves 16 and 17 of the valve block 8, of said lines, which respectively lead to annular chambers 58 and 59 (specifically see FIG. 5) and ensure that the relevant connection is always accomplished, without any need for orienting operations having to be carried out. The corresponding control lines 14' and 15' run through said male fitting 11, with the tight sealing being secured by the gaskets 13. At its bottom end, said valve body 9 ends with a connector bowl 18, which is anchored, in a known way, to said well head 6. This comprises the collars 19 of said borehole strings 7, wherein the smallest-diameter tubing string 7' (see FIG. 4) bounds the true well 20. Inside this the lowermost portion of the completion string 21, which comprises the production tube 22, on which the safety valve of SSSV type 23 acts, and the hydraulic line 24 for the hydraulic drive of said valve 23, is installed.

The upper end of said lower portion of the completion string 21 is then connected with an underwater tubing hanger 25. This is fastened inside the bottom portion of said vertical through-bore 10 by means of a mechanical hooking device 26. This is disengageable by means of a hydraulic-controlled action, and comprises radially expanding sectors, which can radially expand into a corresponding circular groove provided in the body 9 of the valve. The tight sealing between the tubing hanger and the through-bore is secured by annular gaskets 27.

Said tubing hanger 25 is furthermore provided with a through-channel 28. This connects said production tube 22 with the overhanging central area of the through-bore 10. This, in turn, can be closed by means of the gate 29 of the above- said hydraulic-driven gate valve 17. This valve is mounted on the body 9 of the valve block, and, when the actuation pressure is absent, inside control line 15', it automatically returns back into its closure position This is due to the action of its return spring 30. Inside the tubing hanger 25 is also a branched channel 31. This is to connect said control line 24 for the SSSV valve 23, with a corresponding control channel 32 provided in said valve body 9. Furthermore, a second branched channel 33 is provided, to act as the service tube for said lower portion of the completion string 2. This is connected with a corresponding service channel 34 which is also provided in the valve body 9, and which can be closed by means of said gate valve 16, which is analagous to said gate valve 17.

Then, according to a further feature of the present invention, the above-said branched channels 31 and 33 lead to respective annular chambers which are indicated by the reference numerals 53 and 54. These are provided around the peripheral surface of the tubing hanger 25 which ensures that they are always respectively connected with the channels 32 and 34 without a need for orienting operations to be carried out.

Figure 5:
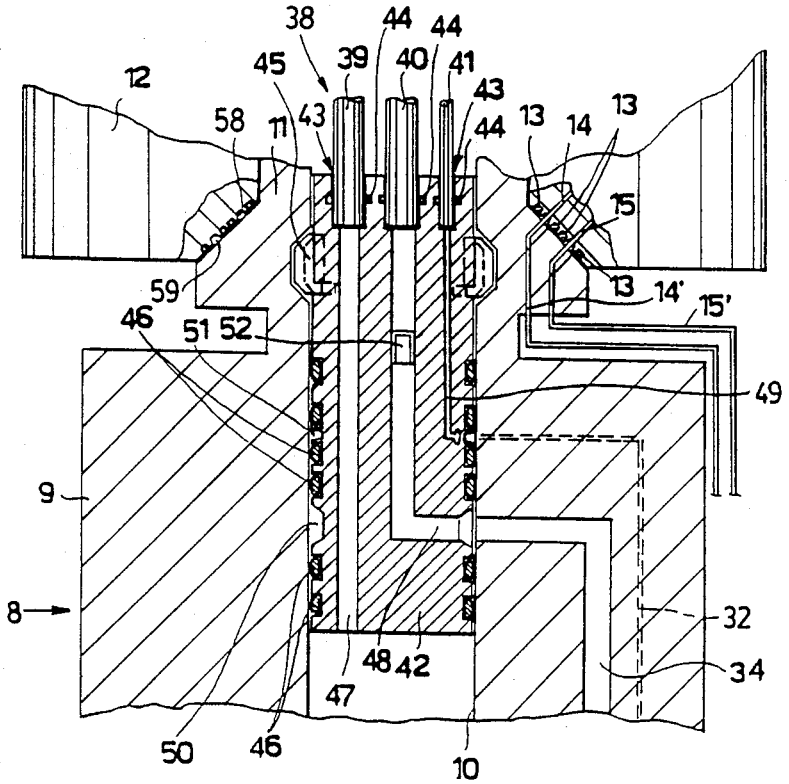
FIG. 5 shows a magnified, sectional, front view of a detail of the valve block of FIG. 4.

On the other hand, according to a preferred form of practical embodiment of the present invention, said tubing hanger 25 is provided, at its lowermost side, with a protruding part 35 (see FIG. 4). This, by means of a ring-shaped gasket 36, creates a further tight seal between the well 20 and the marine environment in addition to the tight seal created by the ring-shaped gasket 37 between the connector bowl 18 and the well head 6.

The upper portion of the completion string 38, which is installed inside the riser 4, comprises the production tube 39, the service tube 40 and the hydraulic control line 41 for the SSSV safety valve 3. It is connected with a packer 42 and the connection, according to a preferred form of practical embodiment of the present invention, is accomplished by means of three housing flares 43 (see FIG. 5). These are provided in the upper portion of-said packer 42, inside which the bottom ends of said tube 39 and 40 and of said control line 41 respectively enter. The tight sealing is secured by the gaskets 44. The packer 42 is then fastened, under tight sealed conditions, inside the upper portion of said vertical through-bore 10 in a way perfectly analogous to that as already described for said tubing hanger 25, i.e., by means of a mechanical hooking device 45, which is disengageable by means of a hydraulic-controlled action, and the annular gaskets 46.

In a still analagous way, said packer 42 is furthermore provided with a through-channel 47. This is to connect said production tube 39 with a branched channel 48. This is to connect said service tube 40 with said service channel 34, and with a further branched channel 49 to connect said control line 41 with said control channel 32. Also in this case, said branched channels 48 and 49 then lead into the respective annular chambers. These are indicated by the reference numerals 50 and 51. These are to facilitate the connection with said channels 34 and 32. In said branched channel 48 a nonreturn valve 52 (see FIG. 5) is further provided, to ensure that the fluid inside the service line flows in one single direction.

The underwater safety valve block allows the hydrocarbon stream to flow from the well up to the underwater safety valve via piping 21. The stream then goes via tubing 22 to the central chamber of the valve block 10. Thence, the stream flows through gate 29 of the main gate valve 17 and reaches the upper packer 42. The stream then flows through the bore 47 to reach the production tubing 39 and can reach the surface. To make such a production run possible, both the underwater safety valve 23 and the maingate valve 17 must be opened. This is achieved by supplying hydraulic pressure, from the surface, along the control line 15, to the riser connector 12. Thereafter, the pressure act, through the annular chamber 59, upon the control line 15' and arrives at the piston of the gate 29. The spring 30 is thereby compressed until the gate 29 reaches its open position. By so doing, the central chamber 10 is allowed to communicate both above and below the gate 29. Hydraulic pressure is now applied, via the control tubing 41, to the housing flare 43 on the upper packer 42. The pressure therefore acts, via bore 49, upon the annular cavity 51 and, thereafter, via bore 32, upon the main block 8, the annular chamber 53, and, via bore 51, upon the tubing hanger 25. The pressurized fluid then flows through tubing 24 and reches the subsurface safety valve 23. The latter can thus be opened. The production flow is discontinued by releasing pressure from the control tubing 41, via the route outlined above, and pressure is released from the underwater safety valve 23 so that it is closed. By releasing pressure from the control line 15, still along the route outlined above, pressure is released from the main gate valve 17. Therefore, the spring 30 biases the gate 29 to close, and the hydraulic fluid flows up the line 15', line 15, and finally to the surface Circulation of the well fluids takes place by pumping from the surface, via the annulus tubing 40, down to the upper packer 50 and, therefrom, via the bore 34 to the tubing hanger 24, and, further via the annular chamber 54, through bore 33, to the annulus 20. (Circulation, as such, takes place at the well bottom, but this is outside the scope of the invention.) To make circulation possible, the annulus gate valve 16 must be opened by hydraulically pressurizing it from the surface, via the control line 14 and the riser connector 12. From the latter, the pressure is active around the annular chamber 58 to reach the control line 14' and the annulus gate valve 16 is thereby reached. Now the pressure is upon the gate spring and the gate is therefore opened. In this way communication becomes possible above and below the annulus gate valve 16 via bore 34. The operation is similar to that of the main gate valve 17.

The underwater Safety Block (USB) has two basic modes of operation: one for the safety of the completion system during the installation and maintenance operations, when the valves shall be opened and closed by he operator following the installation of retrieval procedures; and one for the closure of the well during the operative life, following the breakdown of one or more components of the completion system. These operations can be performed automatically or manually by the operator.

Operations during installation and maintenance operations

During the installation and maintenance operations certain procedures including the operation of the USB valves, must be followed to assure the maximum safety of the well. The following procedure outlines the operation for the retrieval of the tubing. It illustrates for example a maintenance operation procedure.

place a wireline run plug in the downhole packer open the wireline operated sliding sleeve circulate the well with workover fluid.

shut in the well, closing the SCSSV (Surface Control Sub Surface Valve), the production gate valve and the annulus gate valve.

remove the well head, characterized as a "christmas tree" and replace with a surface blow out preventer. This surface blow out preventer is a surface valve for preventing an eruption of the well.

pull the surface tubing hanger, upper tubing and the upper packer.

open the production gate valve and pull the underwater tubing hanger and downhole tubing.

run the 7" workover riser, installing it in the 7" casing hanger.

pull the downhole packer.

The well is now ready for the maintenance operations. The reverse procedure shall be used to prepare the well for return to production.

During all phases of the operation the minimum number of barriers present is two. This is only possible due to the presence of the USB.

Operations during production

During the production life of the well the operator is not normally requested to perform operations on the equipment. The system, being designed to increase the safety of the completion, is automatically closed by a hydraulic skid on the surface which follows alarms that vary from case to case. Example of such alarms might be: loss of pressure in the annulus, uncontrolled flow of hydrocarbons to the surface, emergency status on the topsides, etc.. The operator may also manually perform these operations or override them as he sees fit, utilizing the alarm systems that are traditionally available on board a platform, as well as any others that may have been implemented.

It should be stressed that the alarm systems currently used on platforms are considered sufficient to inform an operator when there is a leak in the completion system. Upon such an alarm, the valves of the USB are closed automatically or by the operator.

Catastrophic events such as the collapse of a riser lead to the immediate shutting of the valves on the USB, as these valves are automatically closed by springs in the event of loss of command pressure. This command pressure is supplied by the dedicated lines that run down the riser, and therefore will be interrupted in such an event.

We claim:

1. An underwater safety valve block for well drilling for the control of flows of product, well fluids, and hydraulic fluids, wherein the safety valve block has a body having a vertical through-bore with an upper, a central and a lower region, a service channel, and a hydraulic control channel, wherein the safety valve block is interposed between a bore-hole string of a well head located on the sea floor and the lowermost end of a riser, wherein the riser connects the well head with a surface platform and wherein the safety valve block comprises:

(a) a completion string of conduits having an upper and a lower portion wherein said completion string includes:
  (1) a production tube for conducting the product flow from the well head,
  (2) a service tube for conducting the well fluid flow, and
  (3) a hydraulic control tube for conducting the flow of hydraulic fluid;

(b) a first hydraulically driven gate valve installed in the body of the safety valve block and located in said service tube for controlling the well fluid flow;

(c) a second hydraulically driven gate valve installed in the central region of the vertical through-bore of the body of the safety valve block and located in said production tube for controlling the flow of product;

(d) a safety valve installed in the lower portion of said production tube for controlling the flow of product;

(e) a subsurface tubing hanger sealed to said lower portion of said completion string inside the lower region of the vertical through-bore by means of gaskets and a first hooking means, wherein said hooking means is hydraulically disengageable and wherein said production tube of said lower portion of said completion string is connected to the central region of the vertical through-bore in the body of the safety valve block by a through channel in said tubing hanger, and wherein said service tube of said lower portion of said completion string is connected to the service channel in the body of the safety valve block by a branched service channel and said hydraulic tube of said lower portion of said completion string is connected to the hydraulic control channel of the body of the safety valve block by a branched hydraulic channel; and (f) a packer element sealed to said upper portion of said completion string inside the upper region of the vertical through-bore by means of gaskets and a second hooking means, wherein said second hooking means is hydraulically disengageable and wherein said production tube of said upper portion of said completion string is connected to the central region of the vertical through-bore int he body of the safety valve block by a through channel in said packer element, and wherein said service tube of said upper portion of said completion string is connected to the service channel in the body of the safety valve block by a branched service channel and said hydraulic central tube of said upper portion o f said completion string is connected to the hydraulic control channel of the body of the safety valve block by a branched hydraulic channel.

2. The device of claim 1, wherein the lower end of said upper portion of said completion string is connected to said packer element by means of housing flares installed int eh top portion of said packer element with gasket means therebetween, which tightly seals said production tube of said upper portion of said completion string to the vertical through-bore, tightly seals said service tube of said upper portion of said completion string to said service channel of said packer element, and tightly seals said hydraulic control tube of said upper portion of said completion string to said hydraulic control channel of said packer element.

3. The device of claim 1 wherein said tubing hanger and said packer element each have on their respective peripheral surface an annular chamber opposite said service tube int h body of the safety valve block and an annular chamber opposite said hydraulic control tube in the body of the safety valve block.

4. The device of claim 1, wherein the bottom of said tubing hanger further comprises a protruding part for tightly sealing to the bore-hole string of the well head by means of a gasket.

* * * * *